US010889990B2

(12) United States Patent
Kastner

(10) Patent No.: US 10,889,990 B2
(45) Date of Patent: Jan. 12, 2021

(54) SKYLIGHT COVER WITH ADVANTAGEOUS TOPOGRAPHY

(71) Applicant: VKR HOLDING, A/S, Horsholm (DK)

(72) Inventor: Steve Roy Kastner, Greenwood, SC (US)

(73) Assignee: VKR HOLDING A/S, Hørsholm (DK)

( * ) Notice: Subject to any disclaimer, the term of this patent is extended or adjusted under 35 U.S.C. 154(b) by 5 days.

(21) Appl. No.: 15/086,941

(22) Filed: Mar. 31, 2016

(65) Prior Publication Data

US 2017/0284103 A1 Oct. 5, 2017

(51) Int. Cl.
*E04D 13/03* (2006.01)
*F21S 11/00* (2006.01)

(52) U.S. Cl.
CPC ..... *E04D 13/033* (2013.01); *E04D 13/032* (2013.01); *F21S 11/002* (2013.01)

(58) Field of Classification Search
CPC ..... E04D 13/033; E04D 13/03; F21S 11/002; F21S 11/007; G02B 19/0042
USPC ... 52/200, 202, 203, 208, 786.1, 786.13, 72, 52/DIG. 10, DIG. 17; 359/591, 592–594, 359/596, 597; 47/29.1, 29.2, 17, 60, 61, 47/69
See application file for complete search history.

(56) References Cited

U.S. PATENT DOCUMENTS 228,282 A * 6/1880 Smith ..... E04D 13/03 52/200
385,270 A * 6/1888 Jacobs ..... E06B 9/24 359/592
586,211 A * 7/1897 Basquin ..... E06B 9/24 359/592
586,216 A * 7/1897 Basquin ..... E06B 9/24 359/592
595,264 A * 12/1897 Ewen ..... F21V 5/02 359/594
602,763 A * 4/1898 Mark ..... F21S 11/00 359/591
655,220 A * 8/1900 Fugman ..... E06B 9/24 359/592
D134,481 S * 12/1942 Borkland ..... D26/122
D158,193 S * 4/1950 Hood ..... D26/122
2,918,992 A * 12/1959 Gelsavage ..... E04B 1/3211 135/87

(Continued)

FOREIGN PATENT DOCUMENTS

CA 2878176 A1 1/2014
CA 2768824 C 9/2014

(Continued)

*Primary Examiner* — Robert Canfield
(74) *Attorney, Agent, or Firm* — Parker Poe Adams & Bernstein, LLP

(57) ABSTRACT

A skylight cover is provided that includes a light transmitting body including first and second integral lenses. The first and second integral lenses define polygonal perimeters, each polygonal perimeter having a first element and a second element residing therein, the first and second elements disposed adjacent to each other in each instance. The skylight cover may include a plurality of ridges and creases, the individual, respective ridges and creases disposed in advantageous configurations. The cover may likewise include a plurality of surfaces, some optionally parallel and some optionally co-planar.

29 Claims, 14 Drawing Sheets

(56) References Cited

U.S. PATENT DOCUMENTS 2,982,054 A * 5/1961 Anderson ..... E04D 13/03 52/200
D196,382 S * 9/1963 Schwartz ..... D25/109
3,203,144 A * 8/1965 Fuller ..... E04B 1/3211 52/537
3,674,620 A * 7/1972 McCarthy et al. ..... B29C 53/26 428/114
3,829,680 A * 8/1974 Jones ..... F21V 5/02 362/330
3,854,255 A * 12/1974 Baker ..... E04B 1/3211 52/81.1
3,918,226 A * 11/1975 Naidus ..... E04D 13/03 454/357
4,071,985 A * 2/1978 Wickwire ..... E04B 1/32 52/81.1
4,236,350 A * 12/1980 Hasselbach, Sr. ..... A01G 9/16 47/17
4,287,690 A * 9/1981 Berger ..... E04B 1/3211 52/81.4
4,288,947 A * 9/1981 Huang ..... E04B 1/32 403/170
4,290,244 A * 9/1981 Zeigler ..... E04B 1/32 52/109
4,291,494 A * 9/1981 Knablein ..... A01G 9/16 47/17
4,491,437 A * 1/1985 Schwartz ..... E04B 1/3211 403/172
4,531,333 A * 7/1985 Huegy ..... E04B 1/3211 52/81.2
4,701,131 A * 10/1987 Hildebrandt ..... A63F 9/12 434/211
4,719,726 A * 1/1988 Bergman ..... E04B 1/3211 52/81.4
4,825,608 A 5/1989 Makin
RE33,710 E * 10/1991 Zeigler ..... E04B 1/3211 52/109
5,123,722 A * 6/1992 Meymand ..... B44F 1/08 359/592
5,416,684 A 5/1995 Pearce
5,444,606 A 8/1995 Barnes et al.
5,467,564 A 11/1995 Dekeyser et al.
5,551,042 A 8/1996 Lea et al.
5,566,516 A * 10/1996 Beaulieu ..... E04B 1/3211 403/171
5,578,139 A 11/1996 Jones et al.
5,623,790 A 4/1997 Lalvani
5,628,154 A 5/1997 Gavette
5,640,811 A * 6/1997 Boyle ..... E04H 4/108 135/142
5,648,873 A 7/1997 Jaster et al.
5,655,339 A 8/1997 DeBlock et al.
5,711,244 A * 1/1998 Knapp ..... B63B 3/13 114/312
5,715,634 A 2/1998 Schultz
5,732,514 A * 3/1998 Organ ..... E04B 1/3211 52/80.1
5,878,539 A 3/1999 Grubb
5,896,712 A 4/1999 Chao
5,896,713 A 4/1999 Chao et al.
5,904,006 A 5/1999 Evans
5,983,581 A 11/1999 DeBlock et al.
6,035,593 A 3/2000 Chao et al.
6,192,643 B1 * 2/2001 Zadok ..... E04B 1/0046 52/204.1
6,256,947 B1 7/2001 Grubb
6,282,849 B1 * 9/2001 Tuczek ..... E04B 1/32 52/648.1
6,292,134 B1 * 9/2001 Bondyopadhyay .... H01Q 3/242 342/374
6,379,212 B1 * 4/2002 Miller ..... A63H 33/084 446/85
6,418,673 B1 7/2002 Flowerday
6,499,260 B2 12/2002 Kasinger et al.
RE38,217 E 8/2003 DeBlock et al.
6,724,535 B1 4/2004 Clabburn
D489,462 S * 5/2004 Blomberg ..... D25/48.7
6,921,314 B2 * 7/2005 Miller ..... A63H 33/084 446/487
6,980,728 B2 12/2005 Ladstatter et al.
7,152,384 B1 12/2006 McCarty
7,185,464 B2 3/2007 Bracale
7,222,461 B2 5/2007 Piano et al.
7,322,156 B1 1/2008 Rillie et al.
7,395,636 B2 7/2008 Blomberg
7,410,284 B2 8/2008 Edmonds
7,546,709 B2 6/2009 Jaster et al.
7,591,108 B2 9/2009 Tuczek
7,593,615 B2 9/2009 Chakmakjian et al.
7,639,423 B2 12/2009 Kinney et al.
7,710,663 B2 5/2010 Barnes et al.
7,736,014 B2 6/2010 Blomberg
7,757,444 B1 7/2010 Halliday
7,859,759 B2 12/2010 Coyle et al.
7,900,405 B1 3/2011 Jacoby
7,957,082 B2 6/2011 Mi et al.
7,965,447 B2 6/2011 Olczak
7,982,956 B2 7/2011 Kinney et al.
D650,914 S * 12/2011 Sincic ..... D25/48.7
8,082,705 B2 12/2011 Jaster
8,083,363 B2 12/2011 Jaster
8,096,085 B2 * 1/2012 Schneider ..... E04B 1/32 403/170
8,098,434 B1 1/2012 Hoffend, Jr. et al.
8,111,968 B2 2/2012 Chakmakjian et al.
8,132,375 B2 3/2012 Jaster
D661,405 S * 6/2012 Sincic ..... D25/48.7
8,369,678 B2 2/2013 Chakmakjian et al.
8,429,874 B2 * 4/2013 Schneider ..... E04B 1/32 52/653.1
8,438,798 B2 5/2013 McLain et al.
8,438,799 B2 5/2013 McLain et al.
8,438,800 B2 5/2013 McLain et al.
8,438,801 B2 5/2013 McLain et al.
8,561,364 B2 10/2013 Pendley et al.
8,567,136 B2 10/2013 Pendley et al.
8,982,467 B2 5/2015 Jaster
9,103,110 B1 * 8/2015 Gerber ..... E04B 1/3211
9,458,620 B2 * 10/2016 Sevtsuk ..... E04B 1/32
9,506,240 B1 * 11/2016 Winter ..... E04B 1/3211
D794,216 S * 8/2017 Kastner ..... D25/48.7
2002/0088185 A1 * 7/2002 Miller ..... E04B 1/3211 52/81.4
2004/0049996 A1 * 3/2004 Blomberg ..... E04D 13/03 52/200
2008/0066393 A1 * 3/2008 Sorensen ..... A63H 33/101 52/81.1
2010/0162637 A1 * 7/2010 Brell-Cokcan ..... E04B 1/32 52/80.1
2010/0224232 A1 9/2010 Cummings et al.
2010/0229854 A1 9/2010 Martin-Lopez
2010/0325979 A1 12/2010 Jaster
2011/0017275 A1 * 1/2011 Zhou ..... H01L 31/02168 136/246
2012/0087113 A1 * 4/2012 McClellan ..... E04D 13/03 362/147
2013/0219825 A1 * 8/2013 Pendley ..... E04D 3/24 52/710
2013/0314795 A1 * 11/2013 Weaver ..... G02B 19/0042 359/591
2013/0340362 A1 * 12/2013 Blomberg ..... E04D 13/032 52/200

FOREIGN PATENT DOCUMENTS

CA 171588 7/2017
CH 681550 A5 4/1993
DE 1709002 U * 10/1955
DE 1709002 A1 5/1971
DE 1709002 A1 * 5/1971 ..... E04B 7/12
DE 2152333 A * 5/1972
DE 4233380 A1 * 4/1994 ..... E04D 13/032

(56) References Cited

FOREIGN PATENT DOCUMENTS

| | | | | | |
|---|---|---|---|---|---|
| EP | 0496690 | A1 | * | 7/1992 | ..... E04C 2/54 |
| FR | 2655077 | A1 | * | 5/1991 | ..... E04C 2/54 |
| GB | 1261196 | A1 | | 7/1968 | |
| GB | 1261196 | A | * | 1/1972 | ..... E04C 2/326 |
| GB | 2384022 | C | | 5/2005 | |
| JP | S63138332 | U1 | | 9/1988 | |
| NL | 7103225 | A | | 9/1972 | |
| WO | WO-2012051095 | A1 | * | 4/2012 | ..... E04D 13/03 |
| WO | WO-2012161765 | A1 | * | 11/2012 | ..... E04D 13/0315 |

* cited by examiner

SKYLIGHT COVER WITH ADVANTAGEOUS TOPOGRAPHY

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates generally to a skylight cover and, more particularly, to a skylight cover with an advantageous topography that includes a plurality of interrelated surfaces, a plurality of ridges and creases, and/or a plurality of polygonal lenses.

Description of the Related Art

Skylights provide effective and efficient internal lighting for buildings, maximizing visual comfort and reducing the need for energy usage for artificial lighting.

In simple form, a skylight includes a rooftop cover, through which sunlight enters the skylight structure. The sunlight is transmitted through the skylight cover to a light channel, which extends to the interior of a building. For example, a skylight may include a light channel through roof trusses or similar structures, the light channel being disposed between the skylight cover and the interior opening of the skylight.

The structural integrity of the skylight system depends upon many factors, among them the strength of the skylight cover. Located on the exterior roof of the building, the skylight cover is exposed to several external forces, including wind and precipitation, all of which must reliably be withstood. At the same time, it is desirable for the material of the skylight cover to be as thin as possible, for at least two reasons. First, thinner material results in a lighter weight for the skylight cover, which is more easily and more inexpensively shipped from the manufacturer to the user and which is more easily handled by workers installing the skylight system. Second, use of thinner material for the skylight cover may result in greater transmission of light through the skylight cover into the skylight system and ultimately to the interior of the building. However, the use of thinner material may result in diminished strength. Thus, the desire for high structural integrity and the desire for a thinner and lighter skylight cover thickness are counterposed in the design of skylight covers.

Another design consideration for skylight covers is the recognition that the sunlight received by a skylight cover is highly directional. In early morning and late afternoon hours, the sunlight incident angle at which sunlight strikes the skylight cover is relatively low. Furthermore, at sunrise and at sunset, sunlight is attenuated due to its relatively longer passage through the Earth's atmosphere. It has been found that the irradiance from sunlight arriving at a skylight from a low incident angle may be further reduced before reaching the interior of a building structure, as the sunlight at a low incident angle tends to be reflected more times within the skylight structure, and thereby lessened, before reaching the interior of the building. It is therefore a design goal to maximize the amount of light received within the skylight structure from transmission of that light through the skylight cover.

Many of the prior art skylight covers are configured only as simple domes with no topographic features. One exception, however, is the skylight cover disclosed in U.S. Pat. No. 7,395,636 and U.S. Pat. No. D489,462. Both patents purport to disclose a skylight cover with an arched main body and convex corrugations disposed around the arch of that main body. However, it has been found that a skylight cover of such a configuration does not optimally achieve the design goals described above. A second exception is a skylight cover depicted in FIGS. 9A and 9B, which will be described in more detail hereinbelow, that is an arched main body with saddle-shaped concavities disposed between curvilinear boundaries residing on the arch. However, this second prior art design likewise has been found not to optimally achieve the design goals described above.

In view of the foregoing, it would be advantageous to provide a skylight cover of increased structural integrity, decreased weight, and increased efficiency in transmitting low-angle incident sunlight.

BRIEF SUMMARY OF THE INVENTION

A skylight cover with advantageous topography is provided. As revealed in the following description and the figures herein, this invention discovers a rugged, efficient technology that improves the structural integrity of a skylight cover while minimizing weight and maximizing the sunlight transmitted through the cover at low-incident angles.

In accordance with certain aspects of certain embodiments of the present technology, a skylight cover is provided with a first surface and a second surface, the first surface being parallel to the second surface. Further, a third surface and a fourth surface are provided, the third surface being parallel to the fourth surface. Additionally, a fifth surface and a sixth surface are provided, the fifth surface being parallel to the sixth surface. Further, a seventh surface and an eighth surface are provided, the seventh surface being parallel to the eighth surface. Neither the first, third, fifth, nor seventh surfaces are parallel.

In accordance with additional aspects of other embodiments of the present technology, the third surface may be adjacent to the first surface and, in certain instances, the fifth surface may also be adjacent to the first and third surfaces.

In certain applications, the first and second surfaces may be at least partially planar, with the at least partial planes of such surfaces residing in the same plane. In particular instances, the seventh and eighth surfaces may be at least partially planar, with the at least partial planes of such surfaces residing in the same plane.

In certain examples, the third surface may be at least partially planar and the at least partial plane of the third surface may reside at an obtuse angle to the at least partial plane of the first surface; in individual examples, the fifth surface may be at least partially planar and the at least partial plane of the fifth surface may reside at obtuse angles to the at least partial plane of the first surface and the at least partial plane of the third surface.

In some embodiments, the cover may define a rectangular periphery and, in some examples, the cover may define an apex within the periphery.

In accordance with still further aspects of other embodiments of the present technology, the third surface may be contiguous with the first surface. In certain applications of such embodiments, the fifth surface may also be contiguous with the first and third surfaces.

In particular applications, the cover may include at least one corrugation. The corrugation may be concave or convex, as preferred in specific installations. Certain examples may include the skylight cover defining a longitude, with the corrugation oriented transverse to the longitude.

In accordance with other aspects of certain embodiments of the present technology, a skylight cover is provided that may include a first ridge, having a first ridge end and a second ridge end. Also included may be a first crease having a first crease end and second crease end, the first crease end being disposed proximate to the first ridge end and the second crease end being disposed apart from the second ridge end. A first face may be bounded by the first ridge and the first crease. Additionally, a second ridge may be provided, the second ridge having a third ridge end and a fourth ridge end. Additionally, a second crease may be included, the second crease having a third crease end and a fourth crease end. The third crease end may be disposed proximate to the third ridge end and the fourth crease end may be disposed apart from the fourth ridge end. A second face may be bounded by the second ridge and the second crease. The first and second ridges, the first and second creases, and the first and second faces may reside within a first panel of the cover.

In accordance with additional aspects of other embodiments of the present technology, the first ridge and the second ridge may be parallel. In particular applications, the first crease and the second crease may be parallel. Still further, in certain configurations the first ridge and the second ridge may be parallel and the first crease and the second crease may be parallel.

In accordance with yet additional aspects of other embodiments of the present technology, the first face and the second face may be parallel.

In accordance with still further aspects of other embodiments of the present technology, at least one of the first and second ridges may be linear.

In accordance with yet still further aspects of other embodiments of the present technology, at least one of the first and second creases may be linear.

In some embodiments, the cover may include a corrugation. For particular applications, the corrugation may be integral with the cover.

In accordance with particular aspects of other embodiments of the present technology, at least one of the first and second faces may be at least partially planar.

In accordance with yet still further aspects of other embodiments of the present technology, the skylight cover may also include a third ridge, the third ridge having a fifth ridge end and a sixth ridge end. Further, a third crease may be provided, the third crease having a fifth crease end and a sixth crease end, the fifth crease end being disposed proximate to the fifth ridge end, and the sixth crease end being disposed apart from the sixth ridge end. Still further, a third face is provided, which may be bounded by the third ridge and the third crease. Still further, a fourth ridge may be provided, the fourth ridge having a seventh ridge end and an eighth ridge end. A fourth crease may likewise be included, the fourth crease having a seventh crease end and an eighth crease end, the seventh crease end being disposed proximate to the seventh ridge end and the eighth crease end being disposed apart from the eighth ridge end. A fourth face may be bounded by the fourth ridge and the fourth crease. The third and fourth ridges, the third and fourth creases, and the third and fourth faces may reside within a second panel of the cover. The cover may define an apex, and the second panel may be disposed between the first panel and the apex In accordance with yet still further certain aspects of certain embodiments of the present invention, a skylight cover is provided that comprises a light transmitting body. The light transmitting body may include an integral first lens and an integral second lens. The first lens may define a first polygonal perimeter. The first lens may have a first element and a second element residing within the first polygonal perimeter, with the second element disposed adjacent to the first element. Further, the second lens may define a second polygonal perimeter. The second lens may have a third element and a fourth element residing within the second polygonal perimeter, the fourth element being disposed adjacent to the third element.

In accordance with additional aspects of other embodiments of the present technology, the first and second elements may reside in different planes. In some examples, the first and third elements may be parallel. In selective illustrations, the first and third elements may be parallel and the second and fourth elements may be parallel. In specific representations, the second lens may be identical to the first lens. In particular applications, at least one of the first, second, third, and fourth elements may be at least partially planar. In individual instances in which the first, second, third, and fourth elements are at least partially planar, the at least partial planes of the first and third elements may be parallel and the at least partial planes of the second and fourth elements may be parallel.

In accordance with additional aspects of other embodiments of the present technology, the first polygonal perimeter may be a partial inverted frustum. In particular embodiments, the first polygonal perimeter may be a partial inverted hexagonal pyramidal frustum.

The foregoing description sets forth broadly certain features of the present technology so that the detailed description below may be better understood and so that the contributions from this invention may be better appreciated. Additional advantages of the invention will be set forth in part in the detailed description below and in part may be apparent from the detailed description or may be learned by practice of the invention. The advantages of the invention will be realized and attained by means of the elements in combinations particularly pointed out in the appended claims. It is to be understood that both the foregoing general description as well as the following detailed description are exemplary and merely explanatory, and are not restrictive of the invention.

BRIEF DESCRIPTION OF THE SEVERAL VIEWS OF THE DRAWINGS

The details of the present technology can be better understood with reference to the accompanying figures. It should be noted that these figures are not necessarily to scale.

DETAILED DESCRIPTION OF THE INVENTION

Figure 1:
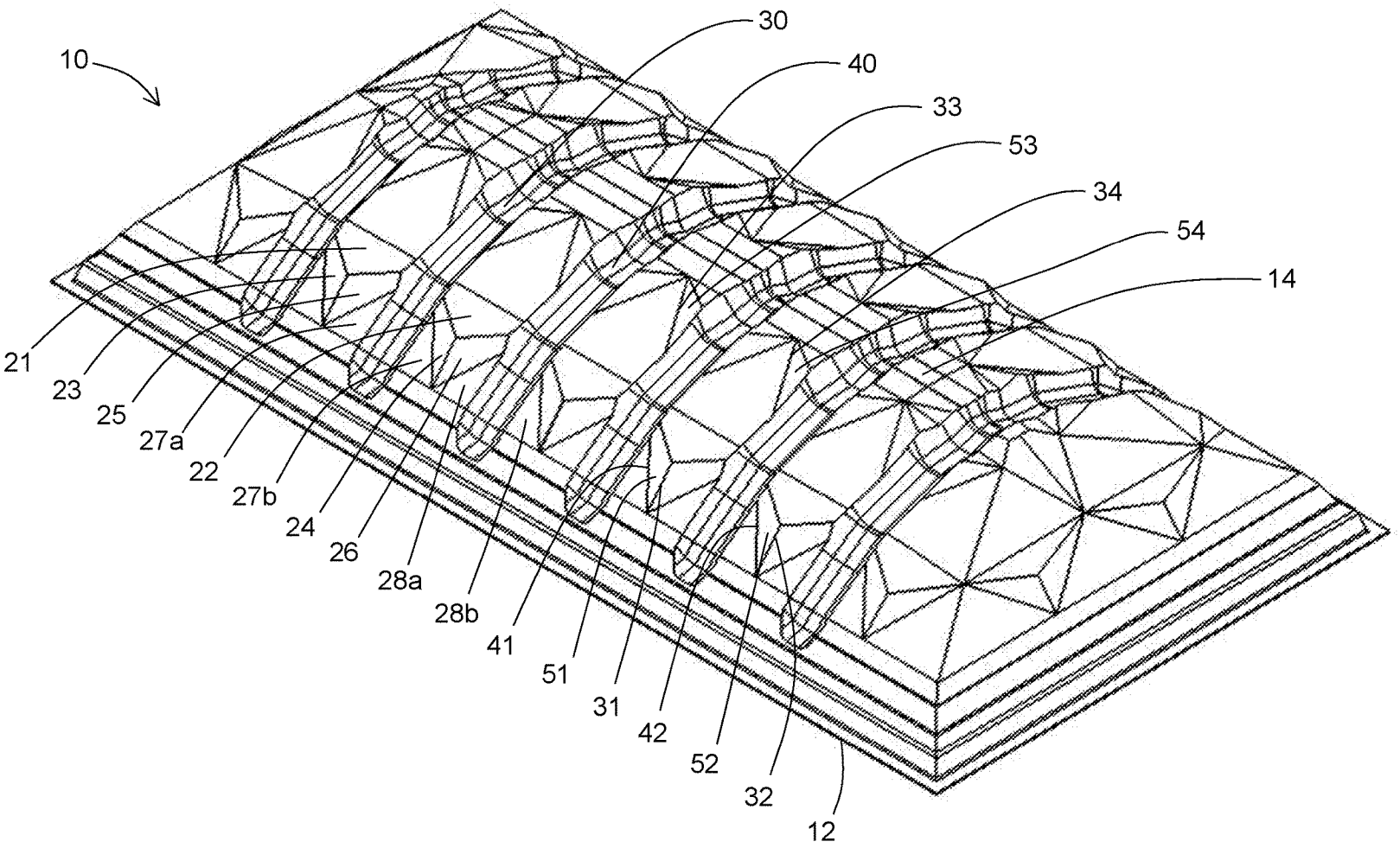
FIG. 1 is a perspective view of an embodiment of a skylight cover with advantageous topography in accordance with certain aspects of the present invention.

Reference will now be made in detail to the presently preferred embodiments of the invention, one or more examples of which are illustrated in the drawings. Each example is provided by way of explanation of this technology, and is not meant as a limitation of the invention. For example, features illustrated or described as part of one embodiment can be used on another embodiment to yield a still further embodiment. Selected combinations of aspects of the disclosed technology correspond to a plurality of different embodiments of the present invention. It is intended that the present application includes such modifications and variations as come within the scope and spirit of the invention. Certain features may be interchanged with similar devices or features not expressly mentioned, which perform the same or similar function. It is to be understood that the terminology used herein is only for the purpose of describing particular aspects and is not intended to be limiting. Repeat use of reference characters throughout the present specification and appended drawings is intended to represent the same or analogous features or elements of the invention.

A skylight cover 10 is provided. Cover 10 is configured to be positioned at the rooftop of a skylight system. Cover 10 is to be at least partially light transmitting. In particular embodiments, cover 10 may be at least partially translucent. In other certain configurations, cover 10 may be at least partially transparent. In still some other examples, cover 10 may be both at least partially translucent and at a least partially transparent.

As disclosed herein, cover 10 has an advantageous topography. In describing such topography herein, "upward" shall be understood to mean projecting away from the skylight system below cover 10. Similarly, "downward" shall be understood to mean projecting toward the skylight system below cover 10.

Cover 10 includes a periphery 12. In some embodiments, periphery 12 may be rectangular, or at least partially rectangular. In other embodiments, periphery 12 may be circular, or at least partially circular. In still other embodiments, periphery 12 may be curvilinear, or at least partially curvilinear. In yet still further embodiments, periphery 12 may be polygonal, or at least partially polygonal.

In certain configurations, cover 10 may project upward from its periphery. In those instances, cover 10 may include an apex 14 defined within periphery 12.

The topography of cover 10 may be understood to include a plurality of surfaces, such as surfaces 21-28. In particular embodiments, one or more of surfaces 21-28 may be parallel to another of surfaces 21-28. In other configurations, one of surfaces 21-28 may be adjacent to another of surfaces 21-28. In still other examples, one of surfaces 21-28 may be both parallel to another of surfaces 21-28 but also adjacent to yet a third of surfaces 21-28. In still yet additional forms, one of surfaces 21-28 may be contiguous to another of surfaces 21-28. In still further illustrations, one of surfaces 21-28 may be both contiguous to another of surfaces 21-28 and adjacent to yet still another of surfaces 21-28.

In the embodiments illustrated in the appended drawings, some of surfaces 21-28 are illustrated as triangular in shape. Such a triangular shape provides an especially strong structure for surfaces 21-28 and, therefore, also for cover 10. However, not all of surfaces 21-28 need be triangular in shape, nor do any of surfaces 21-28 need be triangular in shape according to the present technology.

In particular embodiments, it has been found that the structural strength of cover 10 is increased by the intersections of non-parallel surfaces of surfaces 21-28.

In certain practices of the present technology, one or more of surfaces 21-28 may be at least partially planar. In certain representations, at least two of surfaces 21-28 may be at least partially planar and, in some examples of the present technology, the at least partial planes of two of surfaces 21-28 may reside in the same plane. In certain configurations, in which two of surfaces 21-28 are both partially planar and either adjacent to each other or contiguous with each other, the partial plane of one such adjacent or contiguous surface 21-28 may reside at an obtuse angle to the at least partial plane of another adjacent or contiguous surface 21-28. In still further representations of the present technology, in instances in which for example, a surface 21 is adjacent to or contiguous with both a surface 23 and a surface 25, and surfaces 21, 23, and 25 are at least partially planar, the at least partial plane of surface 23 may reside at obtuse angles to both the at least partial plane of surface 21 and surface 25.

The advantageous topography of cover 10 may also be understood to include a plurality of ridges and creases. A ridge may be understood to define an elongated feature along the surface of cover 10 upward from cover 10. Similarly, a crease may be understood to be an elongated feature along the surface of cover 10 downward from cover 10.

More specifically, cover 10 may include ridges 31-39, 60-69 and 70*a,b*. Ridges 31-39, 60-69 and 70*a,b* may be integral to cover 10. Ridges 31-39, 60-69 and 70*a,b*, and 70*a,b* may be linear, but need not be linear in all applications of the present technology.

Cover 10 may also include creases 41-48 and 75-78. Creases 41-48 and 75-78 may be integral to cover 10. Creases 41-48 and 75-78 may be linear, but need not be linear in all applications of the present technology.

A first exemplary ridge 31 may include a first ridge end 311 and an opposite second ridge end 312. A second ridge 32 may include a third ridge end 323 and a fourth ridge end 324.

Cover 10 may also include a first crease 41, first crease 41 having a first crease end 411 and a second crease end 412. Cover 10 may also include a second crease 42, second crease 42 having a third crease end 423 and a fourth crease end 424. Cover 10 may also include a third crease 43, third crease 43 having a fifth crease end 435 and a sixth crease end 436. Cover 10 may also have a fourth crease 44, fourth crease 44 having a seventh crease end 447 and an eighth crease end 448.

Additionally, cover 10 may define thereon faces 51-54. As illustrated in the appended drawings, some of faces 51-54 in the exemplary embodiments are illustrated to be triangular, which represents an especially strong structural shape. However, not all, or any, of faces 51-54 need necessarily be triangular but instead may be of another shape or of multiple other shapes. In particular embodiments, two of faces 51-54 may be parallel. In some configurations, two or more of faces 51-54 may be adjacent. In particular applications, at least one of faces 51-54 may be parallel to another of faces 51-54 and adjacent to yet a third of faces 51-54. In other instances, at least one of faces 51-54 may be contiguous with another of faces 51-54. Still further, in certain configurations one of faces 51-54 may be both parallel to a second of faces 51-54 and contiguous with yet a third of faces 51-54.

The advantageous topography of cover 10 may be yet still further understood to include a first lens 71 and a second lens 72. First lens 71 may include a first element 81 and a second element 82. Second lens 72 may include a third element 83 and a fourth element 84. In some embodiments, first lens 71 may define a first polygonal perimeter 91, such as by a fifth ridge 35, a fifth crease 45, a sixth ridge 36, and an eighth crease 48. In other embodiments, second lens 72 may be understood to define a second polygonal perimeter 92, such as by a sixth ridge 46, a sixth crease 36, a seventh ridge 37, and seventh crease 47. In some configurations, first polygonal perimeter 91 and second polygonal perimeter 92 may be identical.

In some configurations, first polygonal 91 may define a parallelogram. In other applications, first polygonal 91 and second polygonal perimeter 92 may each define parallelograms.

In other configurations, first polygonal perimeter 91 may define a partial inverted frustum. In other applications, second polygonal perimeter 92 may define a partial inverted frustum. In specific representations, first polygonal perimeter 91 may define a partial inverted hexagonal pyramidal frustum. In other applications, second polygonal perimeter 92 may define a partial inverted hexagonal pyramidal frustum.

Cover 10 may optionally be constructed by assembly of multiple sections. For example, cover 10 may be constructed of a first section 93 representing an end section, a second section 94 representing an opposite end section, and intermediate sections 95*a-d*, each representing intermediate sections between first section 93 and second section 94.

Cover 10 may optionally include one or more corrugations, such as first corrugation 30 and second corrugation 40. Corrugations 30, 40 may be concave, projecting downward toward the skylight system beneath cover 10 such as is illustrated in FIGS. 1, 3, 6, and 8, or they may be convex projecting upward away from the skylight system (not shown). Corrugations 30, 40 may be integral with cover 10, or separate therefrom and attached thereto.

Figure 2A:
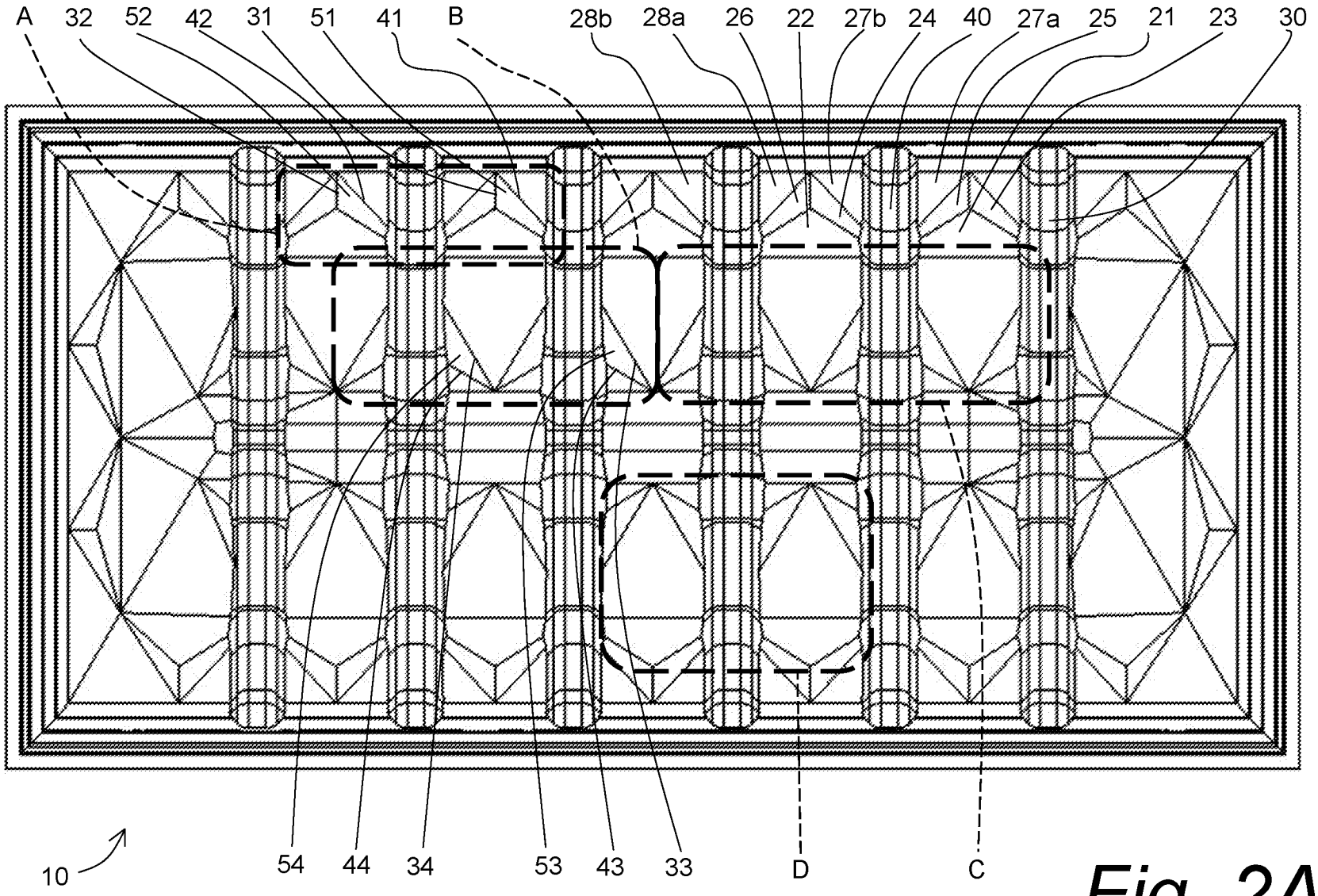
FIG. 2A is a top plan view of an embodiment of a skylight cover with advantageous topography in accordance with certain aspects of the present invention.

Thus, it will be appreciated that cover 10 has an advantageous topography. Consideration of the appended figures will further disclose the present technology. With reference to FIGS. 1 and 2A, an exemplary embodiment of the invention is illustrated. In such embodiment a first surface 21 is parallel to a second surface 22. Further, a third surface 23 and a fourth surface 24 are included that are parallel to each other. Additionally, a fifth surface 25 and a sixth surface 26 are provided, fifth surface 25 being parallel to sixth surface 26. Furthermore, a seventh surface 27*a/b* and an eighth surface 28*a/b* are provided, seventh surface 27*a/b* being parallel to eighth surface 28*a/b*. In the particular embodiment illustrated, for example in FIG. 1, seventh surface 27*a/b* is bisected by first corrugation 30, resulting in seventh surfaces 27*a* and 27*b*; likewise, eighth surface 28*a/b* is bisected by second corrugation 40, resulting in eighth surfaces 28*a* and 28*b*. It will be understood that, in this exemplary embodiment, neither first surface 21, third surface 23, fifth surface 25, nor seventh surface 27*a/b* are parallel to one another.

With continuing reference to the exemplary embodiment illustrated in FIGS. 1 and 2A, third surface 23 is adjacent to first surface 21, and fifth surface 25 is adjacent to first surface 21 and third surface 23. Still further, first surface 21 and second surface 22 may be at least partially planar, with the at least partial planes of such surfaces residing in the same plane. Additionally, seventh surface 27*a,b* and eighth surface 28*a,b* may be at least partially planar, with the at least partial planes of such surfaces residing in the same plane. Moreover, third surface 23 is at least partially planar and the at least partial plane of third surface 23 resides at an obtuse angle to the at least partial plane of first surface 21. Fifth surface 25 is also at least partially planar and the at least partial plane of first surface 25 resides at obtuse angles both to the at least partial plane of first surface 21 and the at least partial plane of third surface 23. First surface 21 is contiguous with third surface 23 and fifth surface 25, and fifth surface 25 is contiguous with first surface 21 and third surface 23.

It will be understood with reference to this exemplary embodiment that cover 10 may define a rectangular periphery 12, with an apex 14 within periphery 12.

Figure 2B:
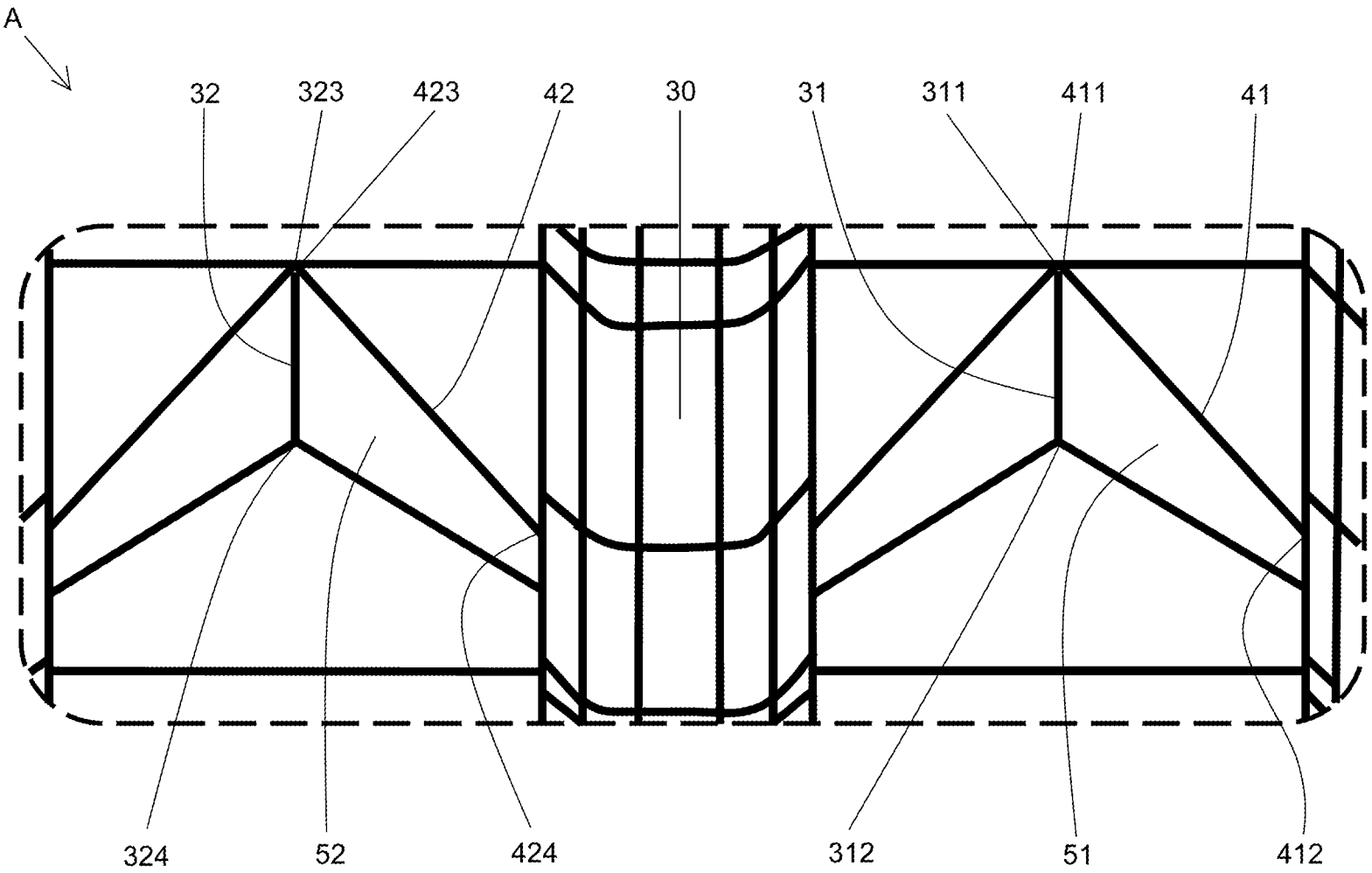
FIG. 2B is an enlarged plan view, taken at A in FIG. 2A, of an embodiment of a skylight cover with advantageous topography in accordance with certain aspects of the present invention.
Figure 2C:
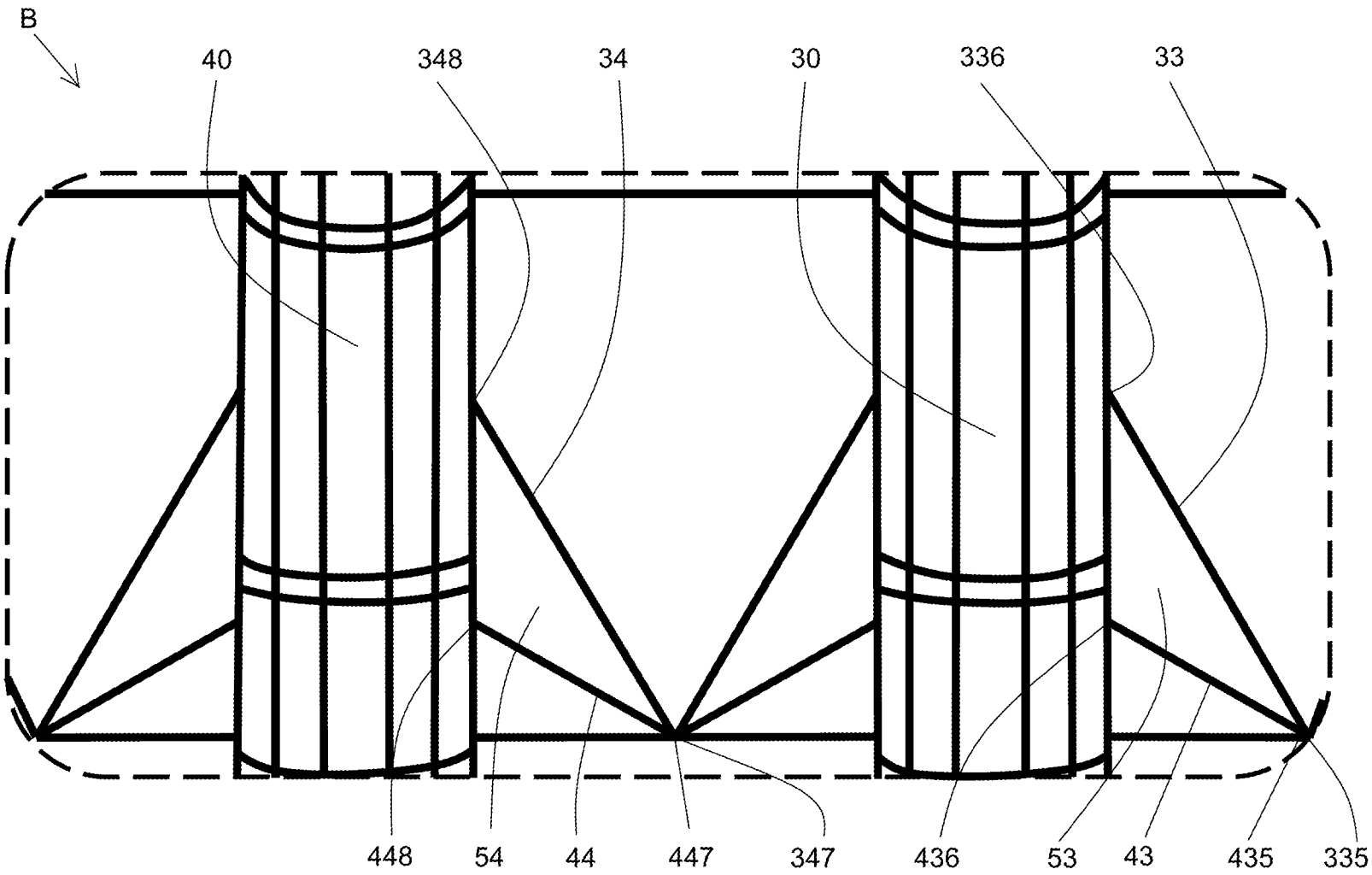
FIG. 2C is an enlarged plan view, taken at B in FIG. 2A, of an embodiment of a skylight cover with advantageous topography in accordance with certain aspects of the present invention.

Continuing still with reference to the exemplary embodiment illustrated in FIGS. 1 and 2A, but also with reference to FIGS. 2B and 2C, the illustrated embodiment of cover 10 may also be understood to include a first ridge 31 having a first ridge end 311 and a second ridge end 312. Also illustrated is a first crease 41, having a first crease end 411 and a second crease end 412, first crease end 411 being disposed proximate to first ridge end 311, and second crease end 412 being disposed apart from second ridge end 312. A first face 51 is bounded by first ridge 31 and first crease 41. Additionally, a second ridge 32 is provided, second ridge 32 having a third ridge end 323 and a fourth ridge end 324. Additionally, a second crease 42 is illustrated, a second crease 42 having a third crease end 423 and a fourth crease end 424. Third crease end 423 is disposed proximate to third ridge end 323 and fourth crease end 424 is disposed apart from fourth ridge end 324. A second face 52 is bounded by second ridge 32 and second crease 42. First ridge 31 and second ridge 32, first crease 41 and second crease 42, and first face 51 and second face 52 reside within a first panel A of cover 10.

It will be understood as to the particular exemplary embodiment illustrated in FIGS. 1, 2A, 2B, and 2C, that first ridge 31 and second ridge 32 are parallel and first crease 41 and second crease 42 are parallel. Furthermore, first face 51 and second face 52 are parallel. Additionally, first ridge 31 and second ridge 32 are linear.

In some applications, including those illustrated for example in FIGS. 1, 2A, and 2C, cover 10 includes a third crease 43, third crease 43 having a fifth crease end 435 and a sixth crease end 436. Still further, a third ridge 33 and a third face 53 provided, third face 53 being bounded by third crease 43 and third ridge 33. A fourth crease 44 is likewise included, fourth crease 44 having a seventh crease end 447 and an eighth crease end 448. A fourth ridge 34 is also provided, along with a fourth face 54 which is bounded by fourth crease 44 and fourth ridge 34. In this particular example, third crease 43 and fourth crease 44 are linear, as are third ridge 33 and fourth ridge 34. Further, for illustrative purposes only, first face 51 and second face 52 are at least partially planar.

Figure 2D:
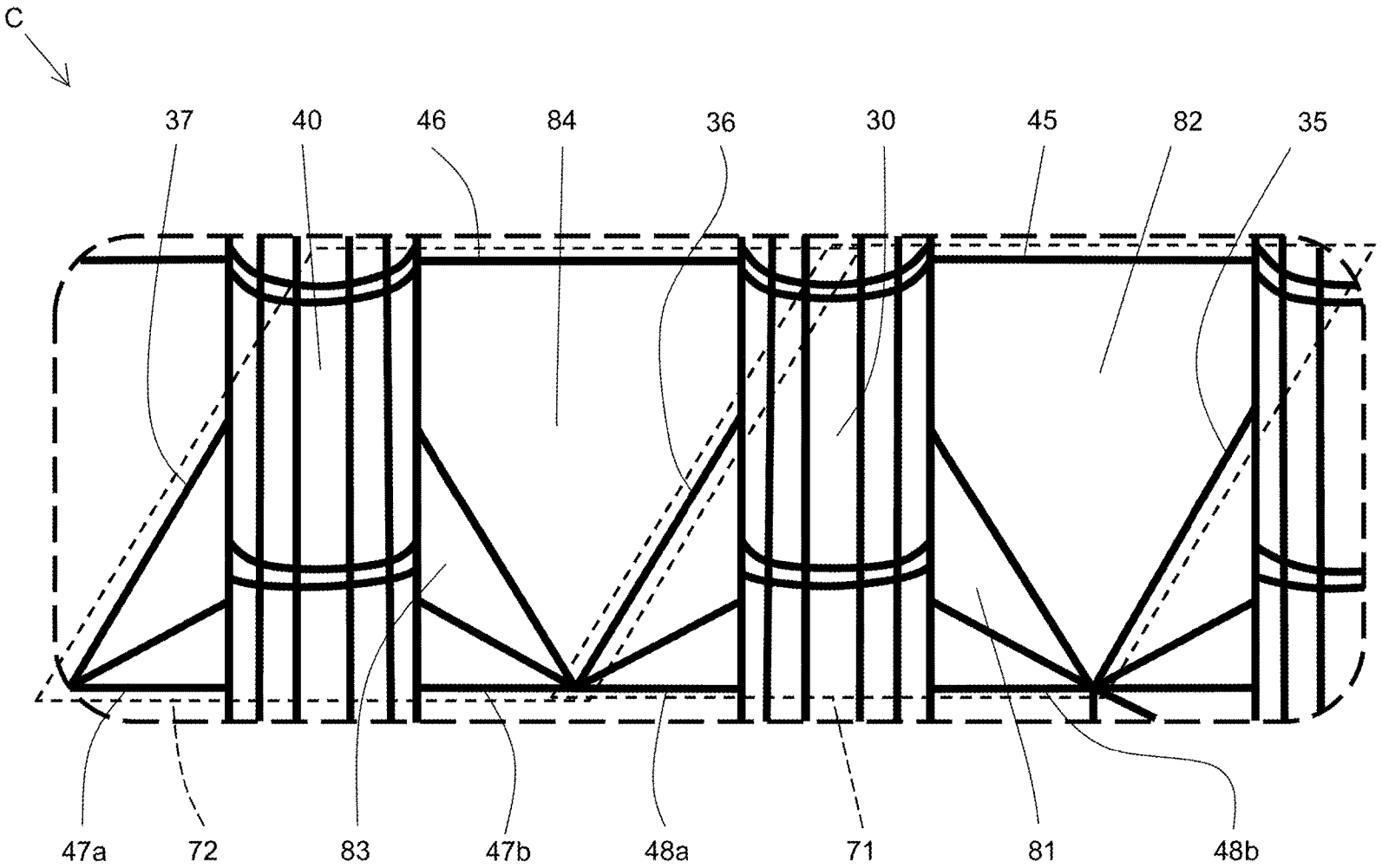
FIG. 2D is an enlarged plan view, taken at C in FIG. 2A, of an embodiment of a skylight cover with advantageous topography in accordance with certain aspects of the present invention.
Figure 2E:
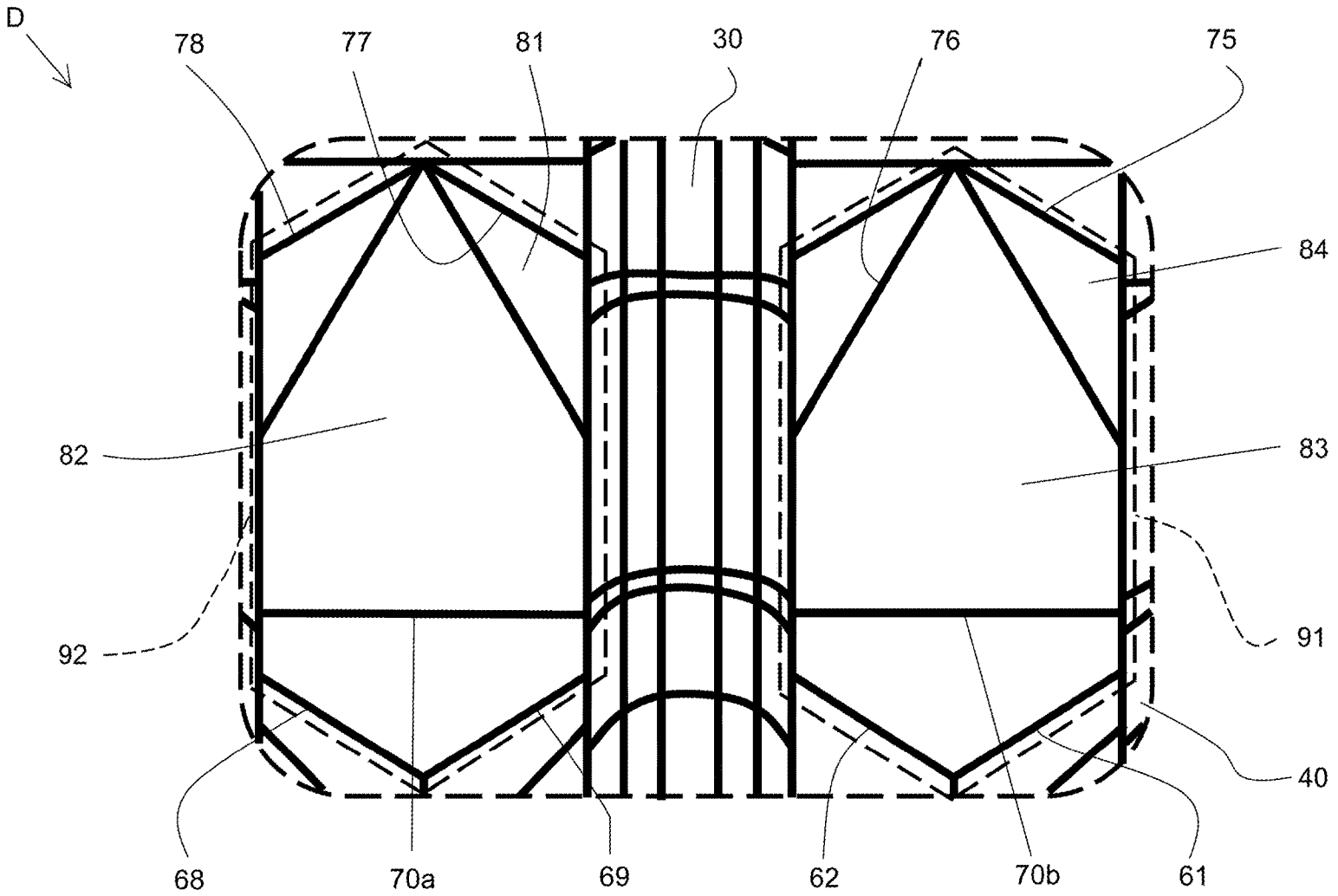
FIG. 2E is an enlarged plan view, taken at D in FIG. 2A, of an embodiment of a skylight cover with advantageous topography in accordance with certain aspects of the present invention.

Referring still to FIGS. 1 and 2A, but now also to FIGS. 2D and 2E, other aspects of the present technology may be further understood. The exemplary cover 10 illustrated therein comprises a light transmitting body. The light transmitting body may include an integral first lens 71 and an integral second lens 72. First lens 71 may define a first polygonal perimeter 91, such as by fifth crease 45, sixth ridge 36, eighth crease 48*a,b*, and fifth ridge 35. First lens 71 may have a first element 81 and a second element 82 residing within first polygonal perimeter 91, and second element 82 may be disposed adjacent to first element 81. Further, second lens 72 may define a second polygonal perimeter 92, such as by sixth ridge 36, sixth crease 46, seventh ridge 37, and seventh crease 47*a,b*. Second lens 72 may have a third element 83 and a fourth element 84 residing within second polygonal perimeter 92, fourth element 84 being disposed adjacent to third element 83.

With reference especially to FIG. 2D, the illustrated embodiment has a first polygonal perimeter 91 that is a parallelogram, as is second polygonal perimeter 92. As an optional practice, first corrugation 30 may bisect first polygonal perimeter 91 and second corrugation 40 may bisect second polygonal perimeter 92, as illustrated. In such an exemplary embodiment, first element 81 and second element 82 reside in different planes and first element 81 and third elements 83 are parallel. Furthermore, first element 81 and third element 83 are parallel and second element 82 and fourth element 84 may be parallel. As may be selected for certain applications, in this exemplary embodiment second lens 72 may be identical to first lens 71. Furthermore, first element 81, second element 82, third element 83, and fourth element 84 may be at least partially planar and the at least partial planes of first element 81 and third element 83 may be parallel and the at least partial planes of second element 82 and fourth element 84 may be parallel.

With reference especially to FIG. 2E, first polygonal perimeter 91 may be a partial inverted frustum. Particularly in this example, first polygonal perimeter 91 is a partial inverted hexagonal pyramidal frustum, bounded by tenth crease 76, first corrugation 30, twelfth ridge 62, eleventh ridge 61, and second corrugation 40. In the exemplary embodiment of FIG. 2E, first element 81 and second element 82 may reside in different planes and first element 81 and fourth element 84 may be parallel. As may optionally be selected for certain applications, in this exemplary embodiment second lens 72 is identical to first lens 71. Furthermore, first element 81, second element 82, third element 83, and fourth element 84 may be at least partially planar and the at least partial planes of second element 82 and third element 83 are parallel and the at least partial planes of first element 81 and fourth element 84 may be parallel.

Figure 3:
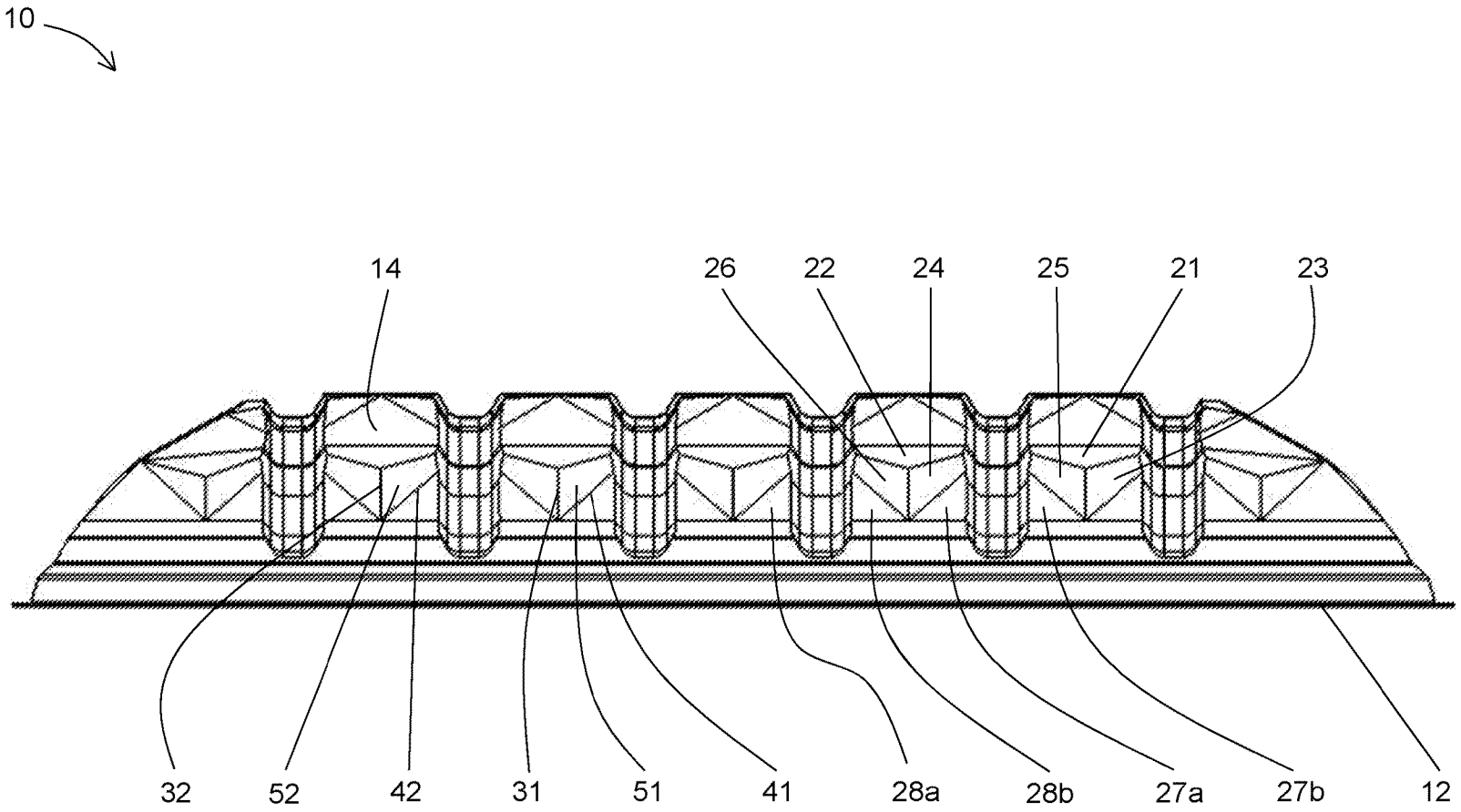
FIG. 3 is a side elevation view of an embodiment of a skylight cover with advantageous topography in accordance with certain aspects of the present invention.

FIG. 3 is a side elevation view of cover 10, illustrating the aforedescribed advantageous topography.

Figure 4:
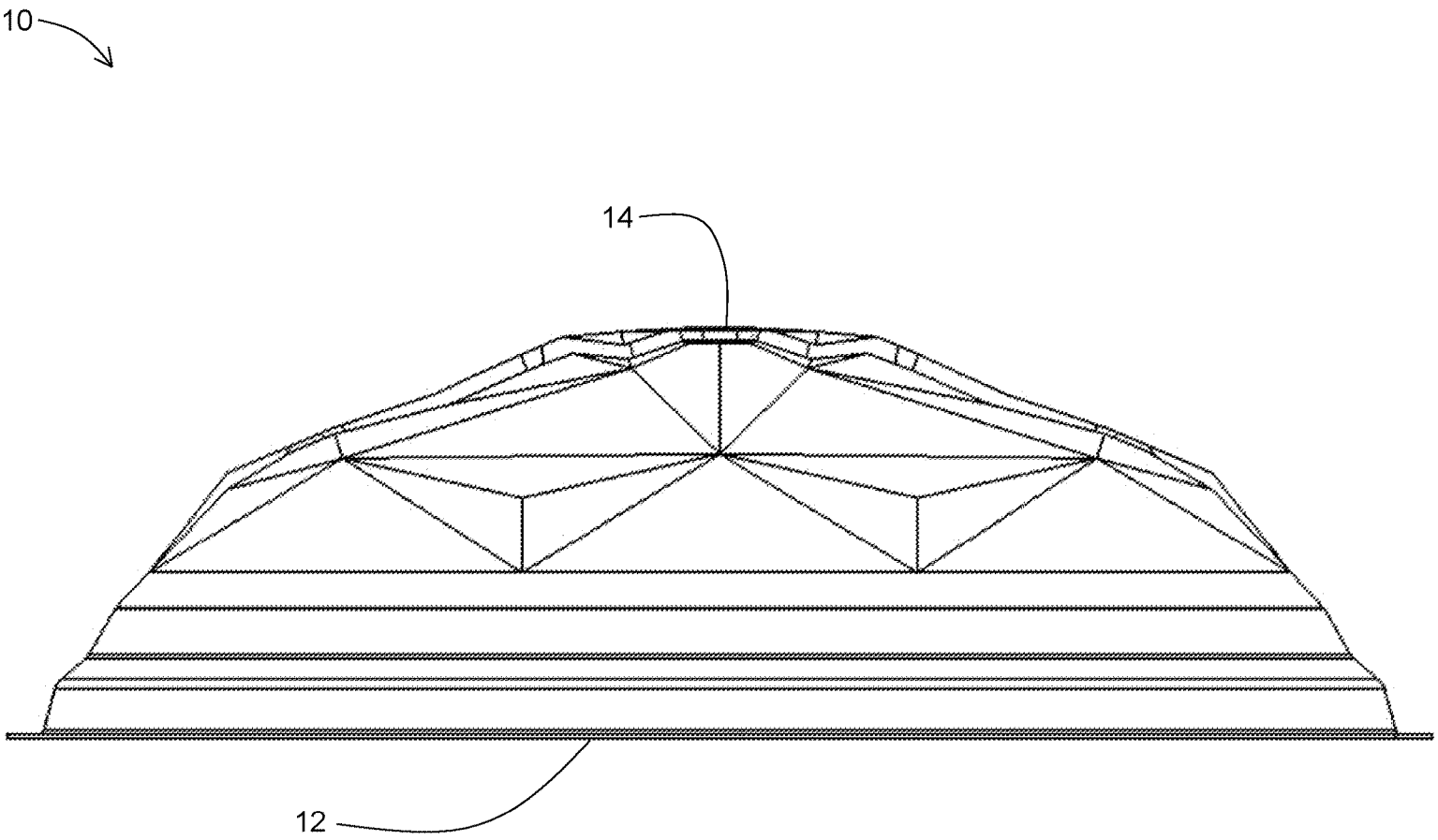
FIG. 4 is an end elevation view of an embodiment of a skylight cover with advantageous topography in accordance with certain aspects of the present invention.

FIG. 4 is an end elevation view of cover 10, further illustrating the aforedescribed advantageous topography.

Figure 5:
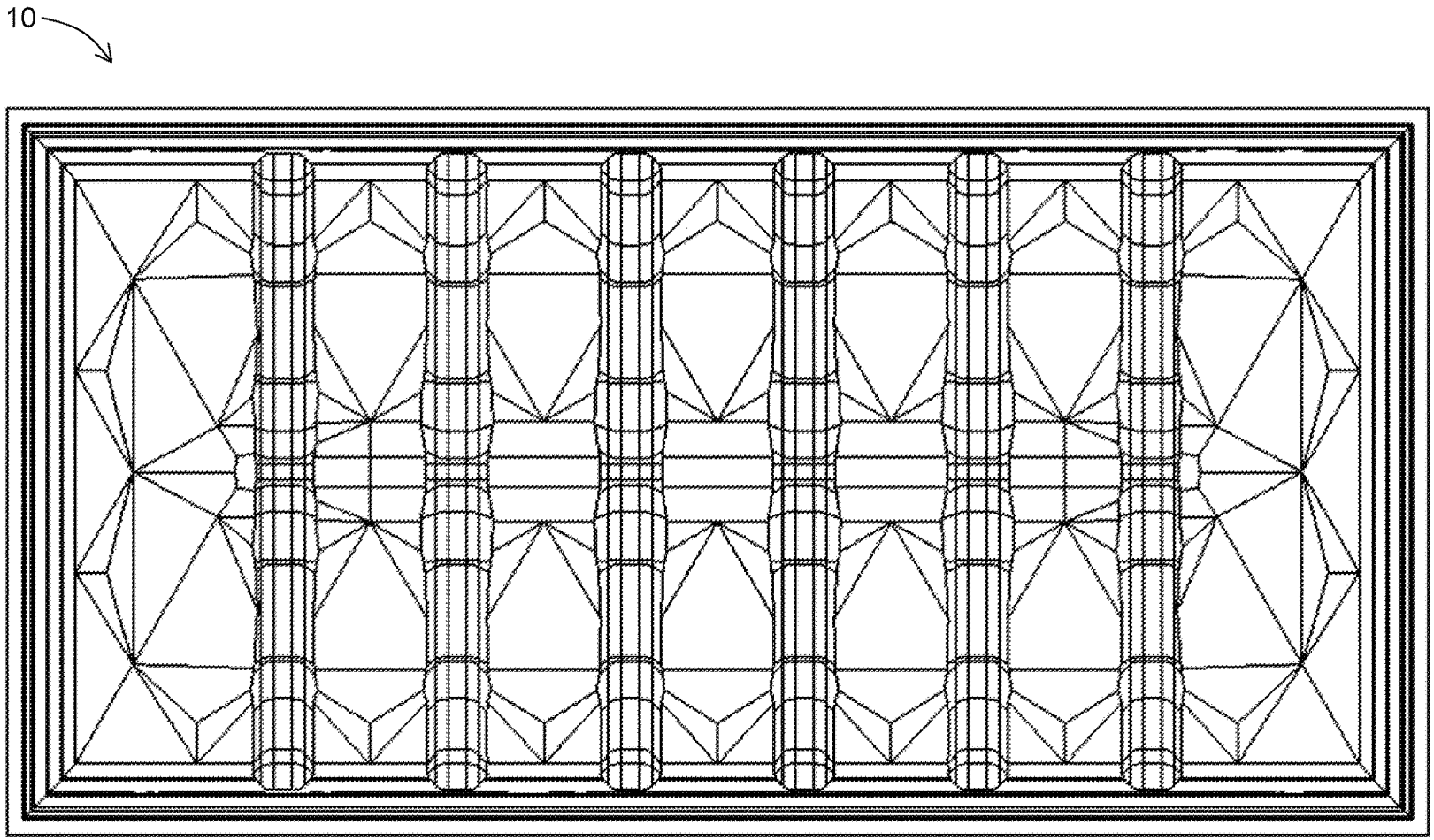
FIG. 5 is a bottom plan view of an embodiment of a skylight cover with advantageous topography in accordance with certain aspects of the present invention.

FIG. 5 is a bottom plan view of cover 10, illustrating the aforedescribed advantageous topography. It will be appreciated that features identified from FIGS. 1 and 2A as ridges would appear to be creases from the perspective of FIG. 5, and features identified in FIGS. 1 and 2A as creases would appear to be ridges from the perspective of FIG. 5.

Figure 6:
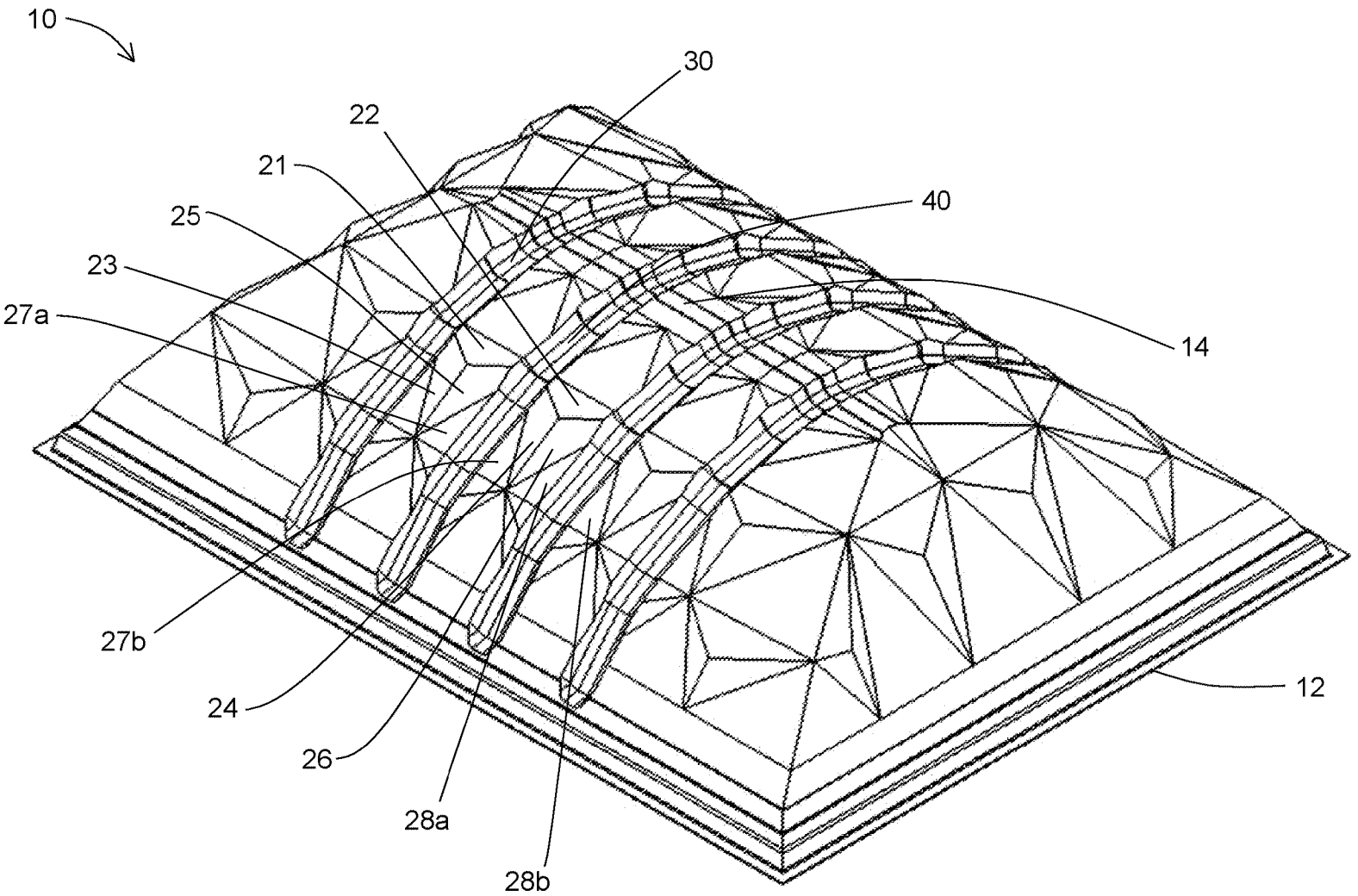
FIG. 6 is a perspective view of an embodiment of a skylight cover with advantageous topography in accordance with certain aspects of the present invention.

FIG. 6 is a perspective view of cover 10, illustrating a construction of cover 10 for a shorter longitudinal dimension by omitting insertion of one or more of intermediate sections 95*a-d*.

Figure 7:
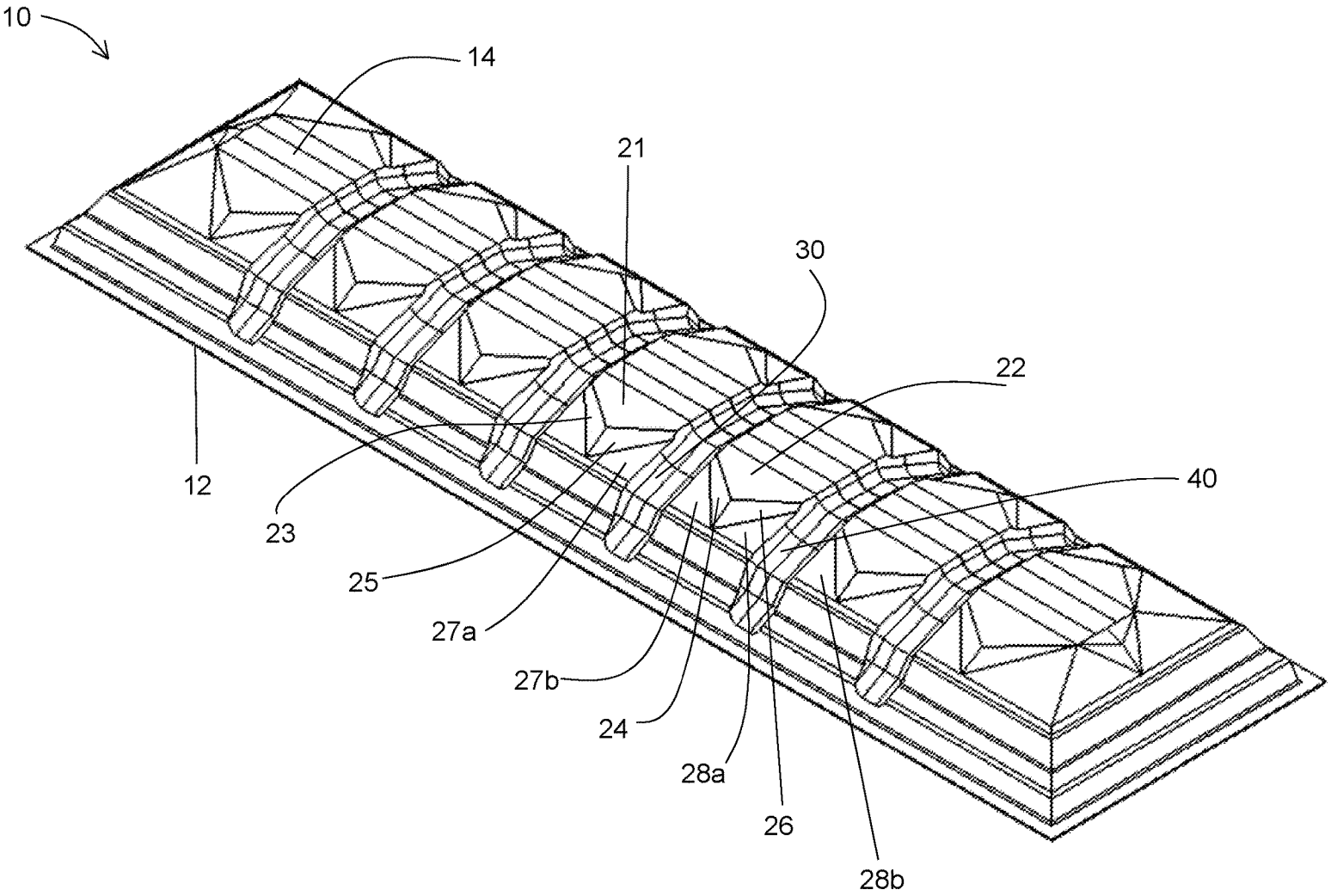
FIG. 7 is a perspective view of an embodiment of a skylight cover with advantageous topography in accordance with certain aspects of the present invention.

FIG. 7 represents another embodiment of cover 10, in which second panels B have been omitted, yet achieving advantageous topography for cover 10.

Figure 8:
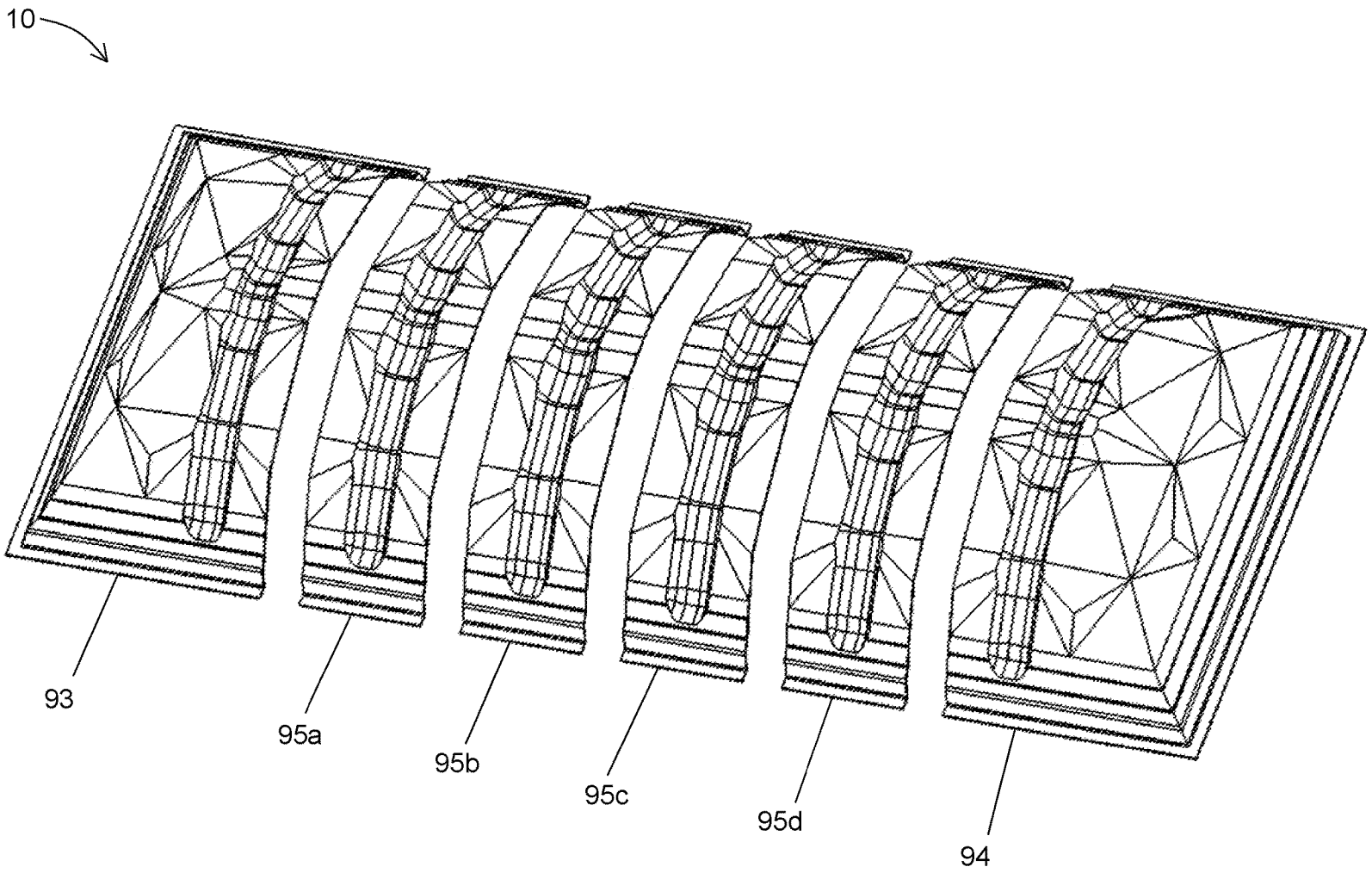
FIG. 8 is an exploded perspective view of an embodiment of a skylight cover with advantageous topography in accordance with certain aspects of the present invention.

FIG. 8 is an exploded perspective view of cover 10, illustrating that cover 10 may be constructed by assembly of a first section 93, a second section 94 and one or more of intermediate sections 95*a-d*. The number of intermediate sections 95*a-d* to be included in a particular assembly of a cover 10 depends upon the longitudinal dimension of cover 10 required for a particular application. The modularity provided by the optional inclusion of one or more of intermediate sections 95*a-d* provides flexibility and economy in the construction of a cover 10.

Evaluation of a prototype of cover 10, constructed with the aforedescribed advantageous topography, has revealed a cover 10 of adequate and sufficient structural strength to withstand the external forces upon such a cover 10, including wind and precipitation. Furthermore, evaluation of such a prototype has revealed achievement of such structural integrity while minimizing the thickness of the material required for construction of cover 10, thereby resulting in a lighter weight for cover 10 which, in turn, is also provided for greater transmission of light through cover 10.

Figure 9A:
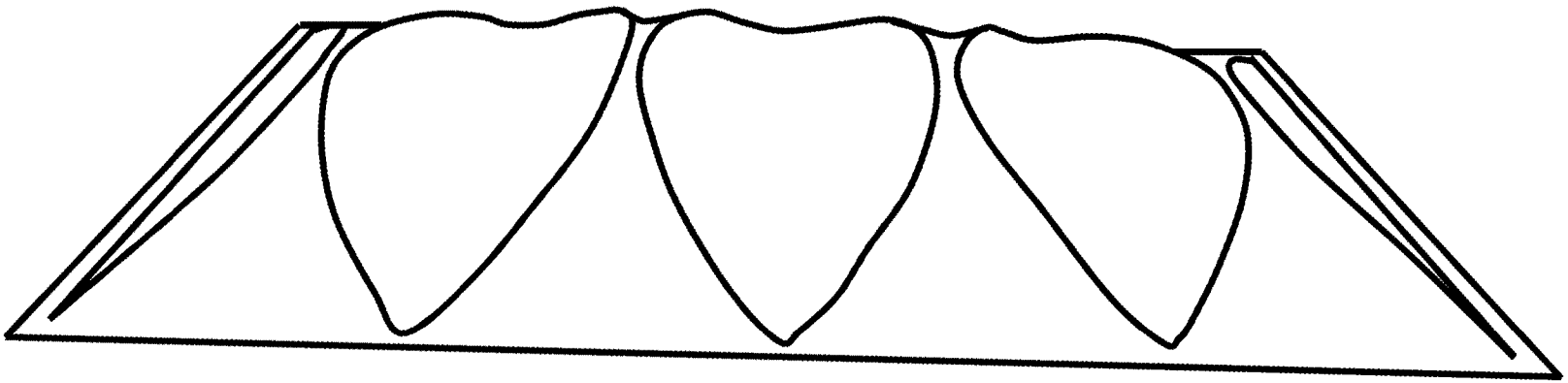
Fig. 9A Prior Art
FIG. 9A is a perspective view of a prior art skylight cover.
Figure 9B:
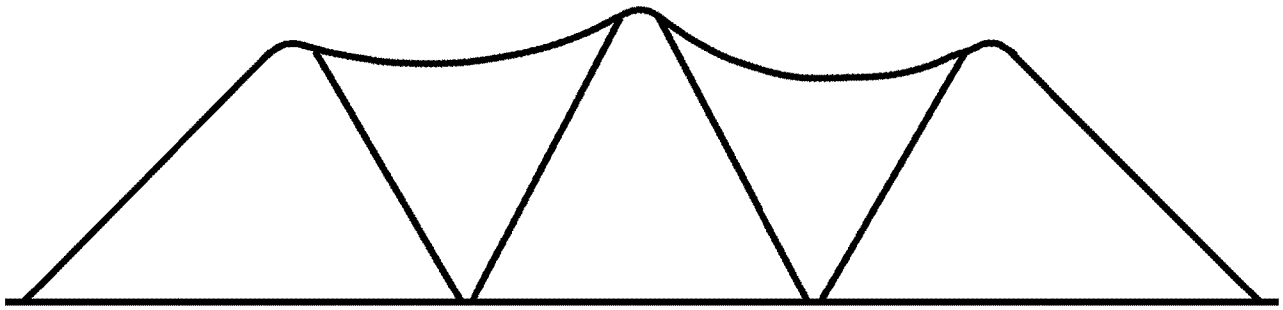
Fig. 9B Prior Art
FIG. 9B is a side elevation view of a prior art skylight cover.

As to the transmission of light through cover 10, cover 10 has also been evaluated to provide higher transmission into a skylight assembly of early morning and late afternoon sunlight. More specifically, cover 10 has been evaluated to provide greater transmission of light upon cover 10 at low incidence angles. Cover 10 has been evaluated for its transmission of low-angle incident light in comparison to the cover disclosed in U.S. Pat. No. 7,395,636 and D489,462, identified above in DESCRIPTION OF THE RELATED ART, which will be referred to hereinafter as "Cover E." Additionally, cover 10 has been evaluated for its performance in transmitting low-angle incident light in comparison to the second prior art device described above in DESCRIPTION OF THE RELATED ART, that with an arched main body and saddle-shaped concavity disposed between curvilinear boundaries residing across such arch. Embodiments of this second alternative design are depicted in FIGS. 9A and 9B. This second, other design will be referred to hereinafter as "Cover F.".

Figure 10:
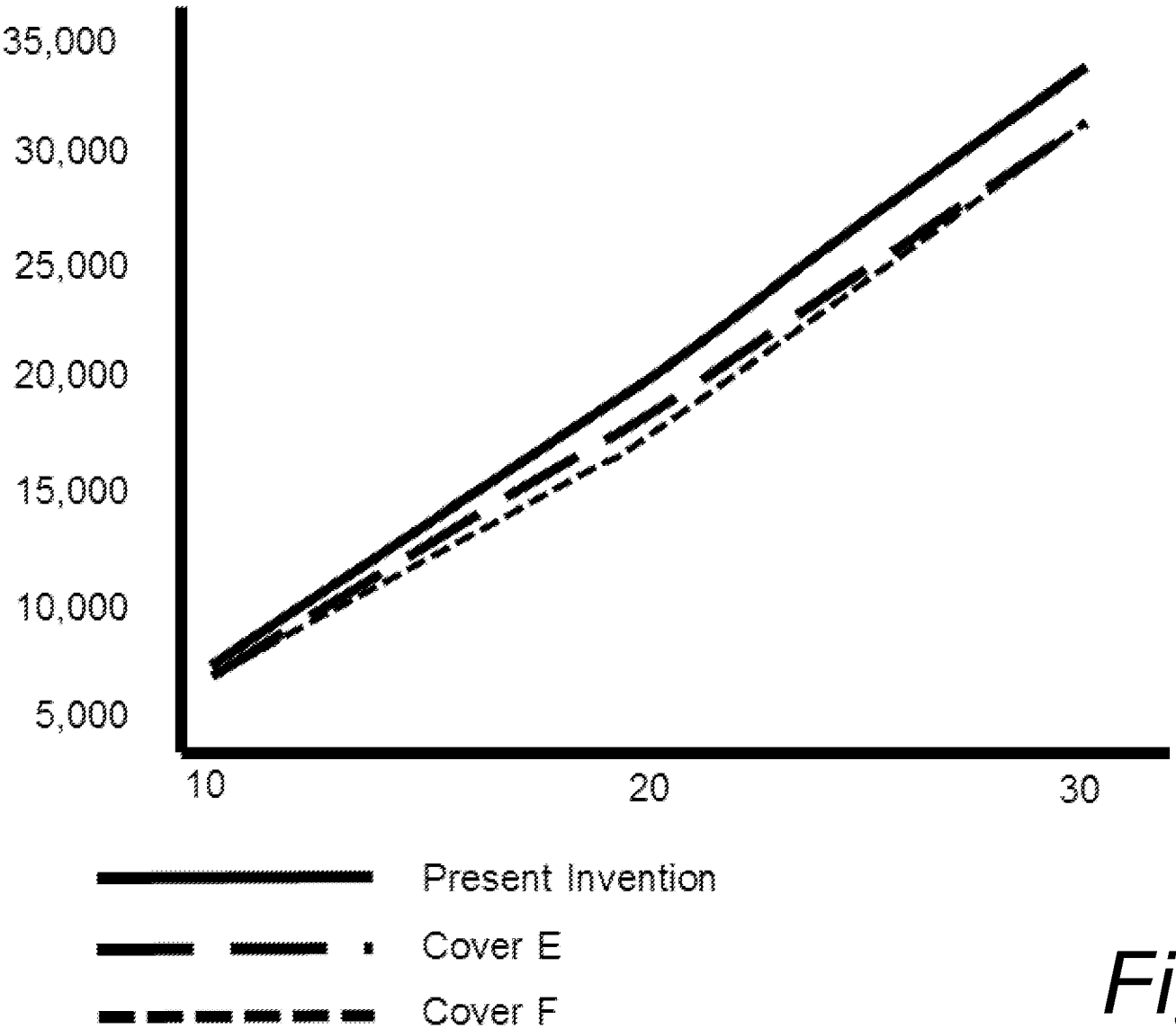
FIG. 10 is a graph illustrating performance of an embodiment of a skylight cover with advantageous topography in accordance with certain aspects of the present invention and that of two prior art skylight covers.

A prototype of a cover 10 in accordance with the foregoing principles was evaluated in two ways relative to Covers E and F. First, all three covers were evaluated for the amount of light transmitted through the respective cover as dependent upon the incident angle of the light upon the respective cover. FIG. 10 illustrates that cover 10 configured in accordance with the foregoing principles achieved superior light transmission as compared to Cover E and Cover F, in which the X-axis denotes the incident light angle and the Y-axis denotes the lumens of light transmitted. The following Table 1 illustrates the numerical values achieved and computed from the foregoing analysis, confirming the superior properties of the present invention compared to these known prior art devices:

TABLE 1

| Sun | Lumens Transmitted | | |
|---|---|---|---|
| Angle | Present Invention | Cover E | Cover F |
| 10 | 7,331 | 6,825 | 6,714 |
| 20 | 19,966 | 18,396 | 17,527 |
| 30 | 33,826 | 31,181 | 31,285 |
| 40 | 47,123 | 43,620 | 45,447 |
| 50 | 59,154 | 55,403 | 58,717 |
| 60 | 69,471 | 65,553 | 69,732 |
| 70 | 77,712 | 73,599 | 78,132 |
| 80 | 83,408 | 79,543 | 83,774 |
| 90 | 85,810 | 81,760 | 85,679 |
| Average | 53,756 | 50,652 | 53,001 |

Covers E and F were evaluated in comparison to the prototype cover 10 constructed in accordance with the foregoing principles, for how much more quickly the cover 10 prototype could achieve a given level of light transmission of low-angle incident light at various latitudes in the United States, compared to Cover E and Cover F. The following Table 2 illustrates the superior results achieved by the cover 10 configured in accordance with the foregoing principles:

TABLE 2

| Number of Minutes Ahead | | | | | | |
|---|---|---|---|---|---|---|
| | Cover E | | | Cover F | | |
| | Winter | Summer | Spring/ Fall | Winter | Summer | Spring/ Fall |
| New York | 22.5 | 14.7 | 14.4 | 23.9 | 15.6 | 15.3 |
| Atlanta | 17.3 | 13.4 | 12.8 | 18.4 | 14.2 | 13.6 |

TABLE 2-continued

| Number of Minutes Ahead | | | | | | |
|---|---|---|---|---|---|---|
| | Cover E | | | Cover F | | |
| | Winter | Summer | Spring/ Fall | Winter | Summer | Spring/ Fall |
| Chicago | 24.1 | 14.9 | 14.7 | 25.6 | 15.9 | 15.6 |
| Los Angeles | 17.3 | 13.4 | 13.1 | 18.4 | 14.2 | 13.9 |
| Seattle | | 16.8 | 16.2 | | 17.8 | 17.3 |

As illustrated in Table 2, the prototype constructed in accordance with the present invention achieved earlier light thresholds than Cover E and Cover F at each of the latitudes in which the three covers were evaluated. This data confirms the superior transmission of light by the prototype cover 10 constructed in accordance with the foregoing principles which, for example, means artificial lighting within a building may be turned down or off sooner in the morning, or up or on later in the evening, by use a cover 10 constructed in accordance with the foregoing principles as compared with either of Covers E and F.

The preceding examples, figures, discussion, and explanations consider specific embodiments. It is to be understood that such specific details are provided for illustrative purposes only and not as limitations to be applied in interpreting the appended claims. It will be further understood that the present technology further encompasses other embodiments that may become obvious to those skilled in the art. It is intended that the present invention includes such modifications and variations as come within the scope of the appended claims and there equivalents.

The invention claimed is:

1. A skylight cover, comprising:

a light transmitting body defining a longitude and having an upward side and a downward side, the downward side defining a concavity, the upward side comprising:

a first surface and a second surface, the first surface being parallel to the second surface a third surface and a fourth surface, the third surface being parallel to the fourth surface;

a fifth surface and a sixth surface, the fifth surface being parallel to the sixth surface;

a seventh surface and an eighth surface, the seventh surface being parallel to the eighth surface; and a first corrugation; wherein none of the first, third, fifth, and seventh surfaces are parallel;

wherein the third surface is directly adjacent to the first surface and the fifth surface is directly adjacent to the first and third surfaces, and wherein the first corrugation resides traverse to the longitude of the body and the first corrugation bisects the seventh surface.

2. The skylight cover of claim 1, in which the first and second surfaces are at least partially planar and the at least partial planes reside in the same plane.

3. The skylight cover of claim 2, in which the seventh and eighth surfaces are at least partially planar and the at least partial planes reside in the same plane.

4. The skylight cover of claim 2, in which the third surface is at least partially planar and the at least partial plane of the third surface resides at an obtuse angle to the at least partial plane of the first surface.

5. The skylight cover of claim 4, in which the fifth surface is at least partially planar and the at least partial plane of the fifth surface resides at obtuse angles to the at least partial plane of the first surface and the at least partial plane of the third surface.

6. The skylight cover of claim 1, in which the seventh and eighth surfaces are at least partially planar and the at least partial planes reside in the same plane.

7. The skylight cover of claim 1, in which the third surface is contiguous with the first surface.

8. The skylight cover of claim 7, in which the fifth surface is contiguous with the first and third surfaces.

9. The skylight cover of claim 1, further including a corrugation.

10. The skylight cover of claim 9, in which the cover defines a longitude and the corrugation resides transverse to the longitude.

11. The skylight cover of claim 1, wherein the upward side further comprises a second corrugation residing traverse to the longitude of the body and wherein the second corrugation bisects the eighth surface.

12. The skylight cover of claim 1, wherein the corrugation is concave projecting downwards towards the downward side.

13. A skylight cover, comprising:

a light transmitting body having a longitude, an exterior surface, and an interior surface, the interior surface being concave, the exterior surface comprising:

a first panel comprising:

a first ridge, the first ridge having a first ridge end and a second ridge end;

a first crease, the first crease having a first crease end and a second crease end, the first crease end disposed proximate to the first ridge end and the second crease end disposed apart from the second ridge end;

a first face bounded by the first ridge and the first crease;

a second ridge, the second ridge having a third ridge end and a fourth ridge end;

a second crease, the second crease having a third crease end and a fourth crease end, the third crease end disposed proximate to the third ridge end and the fourth crease end disposed apart from the fourth ridge end; and a second face bounded by the second ridge and the second crease, wherein the first crease and the second crease are parallel and at least one of the first face and second face is triangular;

a corrugation residing traverse to the longitude of the body, wherein the corrugation bisects the first panel between the first face and the second face;

a second panel; and an apex and the second panel is disposed between the first panel and the apex of the exterior surface.

14. The skylight cover of claim 13, in which the first ridge and the second ridge are parallel.

15. The skylight cover of claim 13, in which the first face and the second face are parallel.

16. The skylight cover of claim 13, in which at least one of the first and second ridges is linear.

17. The skylight cover of claim 13, in which at least one of the first and second, creases is linear.

18. The skylight cover of claim 13, further including an integral corrugation.

19. The skylight cover of claim 13, in which at least one of the first and second faces is at least partially planar.

20. The skylight cover of claim 13, wherein the second panel includes;

a third ridge, the third ridge having a fifth ridge end and a sixth ridge end;

a third crease, the third crease having a fifth crease end and a sixth crease end, the fifth crease end disposed proximate to the fifth ridge end and the sixth crease end disposed apart from the sixth ridge end;

a third face bounded by the third ridge and the third crease;

a fourth ridge, the fourth ridge having a seventh ridge end and an eighth ridge end;

a fourth crease, the fourth crease having a seventh crease end and an eighth crease end, the seventh crease end disposed proximate to the seventh ridge end and the eighth crease end disposed apart from the eighth ridge end; and a fourth face bounded by the fourth ridge and the fourth crease.

21. A skylight cover, comprising:

a light transmitting body, the light transmitting body including a longitude, a first corrugation, an apex, an integral first lens, and an integral second lens;

the first lens defining a first polygonal perimeter, and having a first element and a second element residing within the first polygonal perimeter, the second element disposed adjacent to the first element, the first lens further comprising a first surface and a first ridge residing within the first polygonal perimeter, the first ridge disposed between the first surface and both the first and second elements, the first and second elements disposed between the apex of the light transmitting body and the first surface;

the second lens defining a second polygonal perimeter, and having a third element and a fourth element residing within the second polygonal perimeter, the fourth element disposed adjacent to the third element;

the first lens being integral with the second lens;

the first corrugation residing traverse to the longitude and intersecting the first lens; and the light transmitting body defining an inverted U-shape in cross section.

22. The skylight cover of claim 21, in which the first and second elements reside in different planes.

23. The skylight cover of claim 21, in which the first and third elements are parallel.

24. The skylight cover of claim 21, in which the first and third elements are parallel and the second and fourth elements are parallel.

25. The skylight cover of claim 21, in which the second lens is identical to the first lens.

26. The skylight cover of claim 25, in which the first, second, third, and fourth elements are at least partially planar, the at least partial planes of the first and third elements are parallel, and the at least partial planes of the second and fourth elements are parallel.

27. The skylight cover of claim 26, in which the first polygonal perimeter is hexagonal.

28. The skylight cover of claim 21, in which at least one of the first, second, third, and fourth elements is at least partially planar.

29. The skylight cover of claim 21, wherein the light transmitting body further includes a second corrugation residing traverse to the longitude of the body and intersecting the second lens.

* * * * *